US007971537B2

(12) United States Patent
Verl et al.

(10) Patent No.: US 7,971,537 B2
(45) Date of Patent: Jul. 5, 2011

(54) AMUSEMENT RIDE

(76) Inventors: Alexander Verl, Ludwigsburg (DE); Gino De-Gol, Heathcote (GB)

( * ) Notice: Subject to any disclaimer, the term of this patent is extended or adjusted under 35 U.S.C. 154(b) by 0 days.

(21) Appl. No.: 12/239,744

(22) Filed: Sep. 27, 2008

(65) Prior Publication Data

US 2009/0084285 A1 Apr. 2, 2009

(30) Foreign Application Priority Data

Sep. 27, 2007 (DE) ..... 10 2007 048 012

(51) Int. Cl.
*A63G 31/00* (2006.01)
*A63G 31/16* (2006.01)

(52) U.S. Cl. ..... 104/53; 472/61; 104/83; 104/84

(58) Field of Classification Search ..... 104/53, 104/83, 84; 345/31; 463/5; 472/59–61, 472/130; 434/37
See application file for complete search history.

(56) References Cited

U.S. PATENT DOCUMENTS

| | | | | |
|---|---|---|---|---|
| 1,890,137 | A * | 12/1932 | Traver | 104/63 |
| 5,716,281 | A * | 2/1998 | Dote | 472/60 |
| 5,785,592 | A * | 7/1998 | Jacobsen | 463/7 |
| 6,462,769 | B1 * | 10/2002 | Trowbridge et al. | 348/51 |
| 6,463,859 | B1 * | 10/2002 | Ikezawa et al. | 104/53 |
| 6,796,908 | B2 * | 9/2004 | Weston | 472/43 |
| 2006/0293110 | A1 * | 12/2006 | Mendelsohn | 472/137 |
| 2010/0062866 | A1 * | 3/2010 | Schnuckle | 472/78 |

* cited by examiner

*Primary Examiner* — S. Joseph Morano
*Assistant Examiner* — Zachary Kuhfuss
(74) *Attorney, Agent, or Firm* — Gudrun E. Huckett

(57) ABSTRACT

The carnival ride has a travel path for cars with seats and at least one screen arranged adjacent to the travel path. In order to design the carnival ride in such a way that the passengers in the car have an optimal gaming experience, the screen follows the car at least along a section of its travel distance. In this way, the passengers in the car have a very long-lasting visual contact with the screen or with the movie shown on the screen.

19 Claims, 2 Drawing Sheets

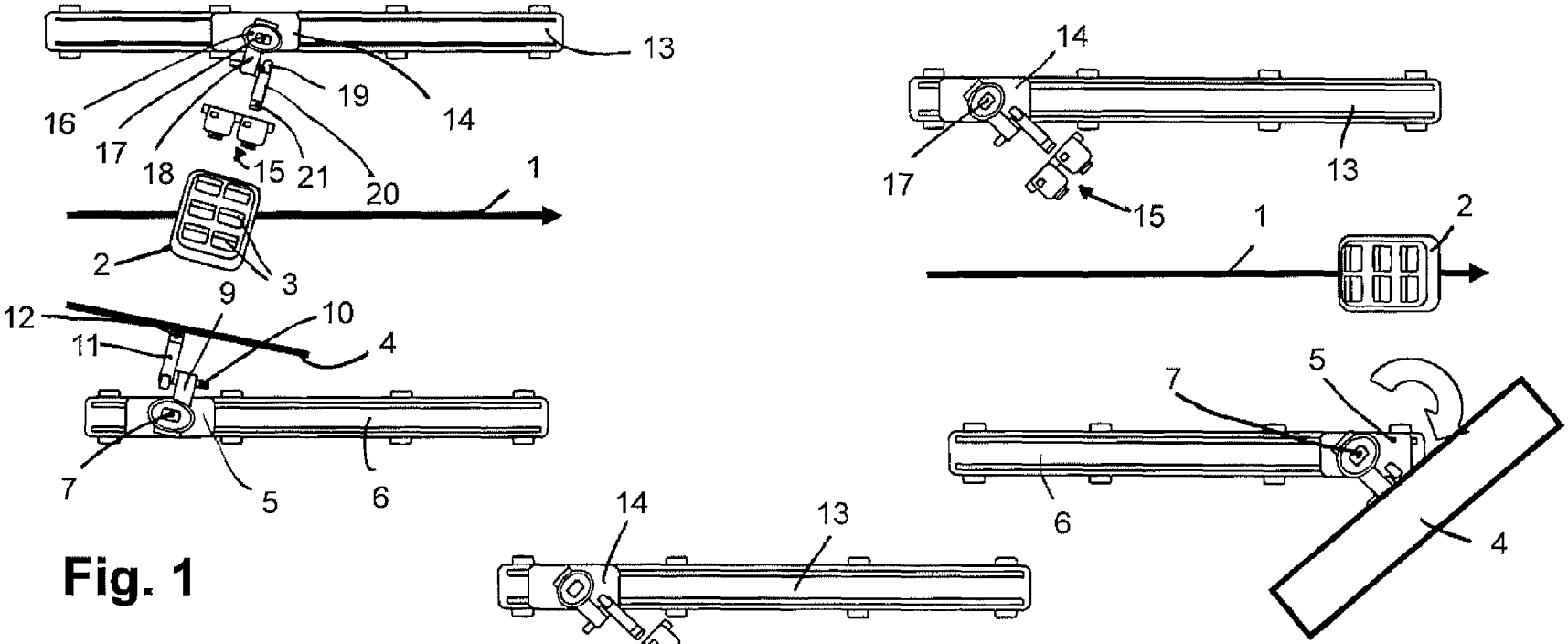
Fig. 1
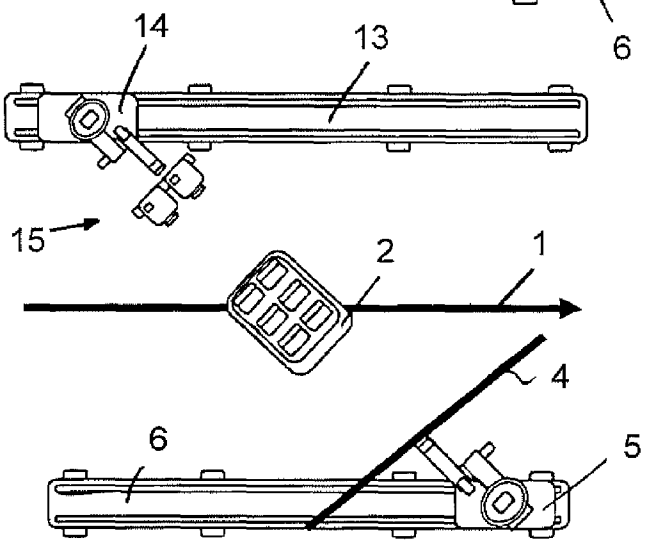
Fig. 2
Fig. 3

AMUSEMENT RIDE

BACKGROUND OF THE INVENTION

The invention concerns an amusement ride, with at least one travel path for cars provided with at least one seat and with at least one screen arranged adjacent to the travel path, Amusement rides are known that have tracks on which cars provided with seats for passengers are traveling. The cars are moved past stationary screens on which movies are shown. The movies are preferably designed such that the passengers by means of appropriate gaming devices such as light guns can shoot at objects on the shown image in order to collect points in this way. Since the screens are however stationarily arranged next to the tracks, the visual impression for the traveling passengers is not optimal.

The invention has the object to design an amusement ride of the aforementioned kind in such a way that the passengers in the car have an optimal game experience.

SUMMARY OF THE INVENTION

This object is solved for the amusement ride of the aforementioned kind in accordance with the present invention in that the screen follows the car at least over a section of its travel path.

In the amusement ride according to the invention, the screens are not arranged stationarily but they follow the car with the passengers at least over a section of its travel path. In this way, the passengers in the car have a long-lasting visual contact with the screen or the movie being shown on it. In this way, the passengers have a very realistic impression of the movie action happening on the screen.

BRIEF DESCRIPTION OF THE DRAWINGS

The invention will be explained in more detail with the embodiment illustrated in the drawings. It is shown in:

FIG. 1 a schematic representation of a first position of a video device within an amusement ride according to the invention.

FIG. 2 a schematic representation of a second position of a video device within an amusement ride according to the invention.

FIG. 3 a schematic representation of a third position of a video device within an amusement ride according to the invention.

DESCRIPTION OF PREFERRED EMBODIMENTS

Figure 4:
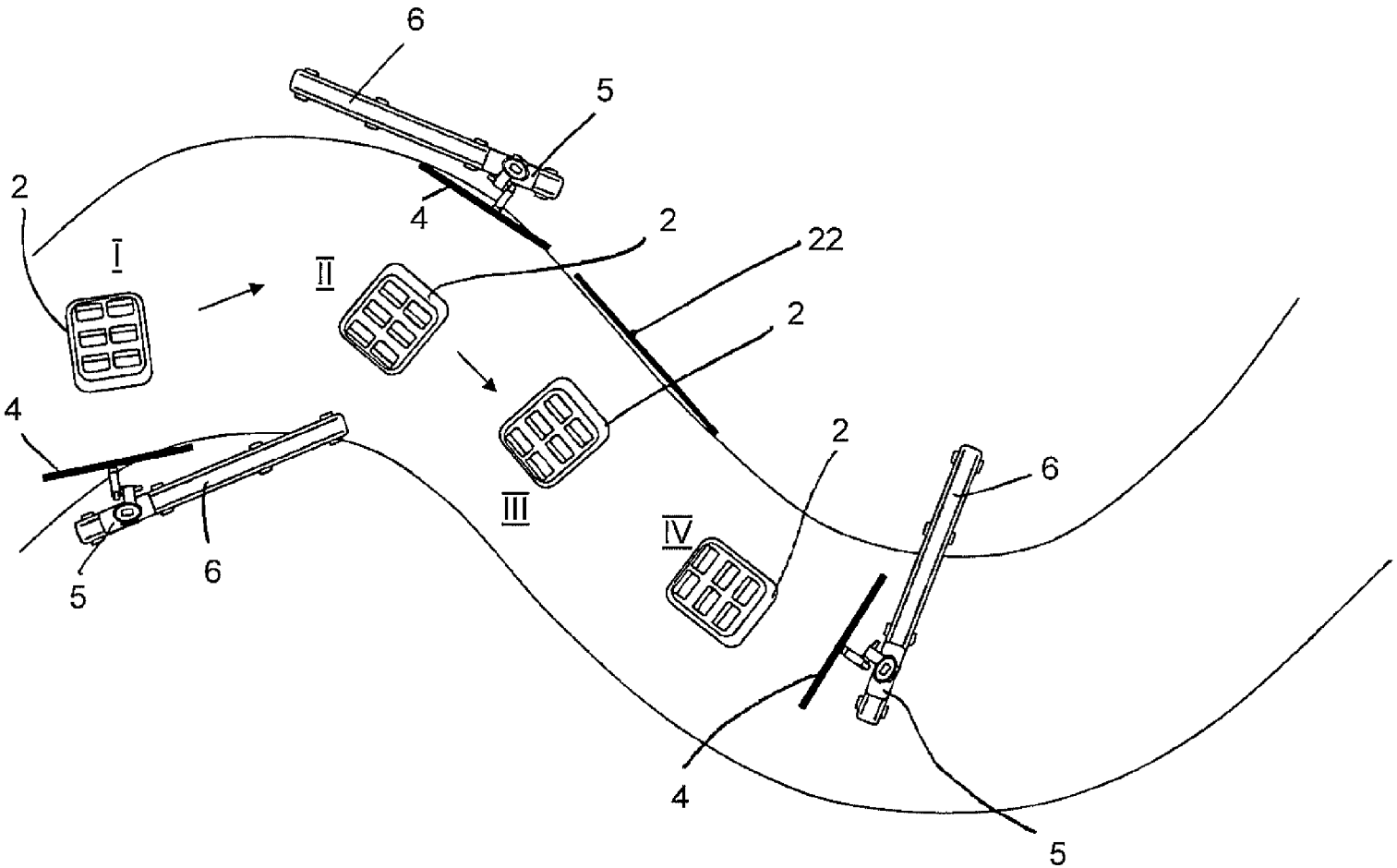
FIG. 4 a schematic illustration of a part of the amusement ride with several video devices.

The amusement ride comprises e.g. tracks as a travel path 1. Also conceivable is a driverless transport system (DTS). On the travel path 1 a car 2 is movable that has several seats 3 for persons. While traveling on the travel path 1, the car 2 can be rotated in a controlled fashion on the travel path 1 about an axis that is perpendicular to the travel path.

The car 2 is oriented on the travel path 1 always in such a way that the persons seated on the seats 3 view a screen 4 that is movable by a carriage 5 on a travel path 6 that is formed for example by tracks. Instead of the carriage 5 any other type of transport element can be used. For example, it can be moved along a rail. The transport element can be arranged so as to be suspended from a rail, for example. The movement of the carriage 5 along the travel path 6 is advantageously matched to the movement of the car 2 on the travel path 1 such that the viewers in the car 2 always have the same viewing angle relative to the screen 4. The screen 4 is for this purpose advantageously adjustable about three axes. The carriage 5 has a pivot axis 7 that is positioned perpendicularly to the travel path 6 and by means of which a support 8 can be rotated. An arm 9 projects from the support and has at its free end a pivot axis 10 that is perpendicular to the pivot axis 7. A support arm 11 is fixedly mounted on the axis and a screen 4 is pivotably connected with its back to the support arm. At the free end of the support arm 11 there is a further pivot axis 12 that is positioned parallel to the pivot axis 10 and about which the screen 4 can be pivoted relative to the support arm 11. The pivot axes 7, 10, 12 are controlled axes that can be actuated by a control unit (not illustrated).

On the carriage 5 additional screens 4 can be provided that are advantageously adjustable independent from one another in the described way.

On the opposite side of the travel path 1 there is a further travel path 13 on which a carriage 14 is movable. The travel path 13 is also formed by tracks, rails and the like. The carriage 14 can be any suitable transport element that, for example, is suspended from a rail. On the carriage 14 a projecting device 15 is supported with which a movie is projected onto the screen 4. The projecting device 15 can be moved advantageously also about three axes relative to the carriage 14 so that the projecting device 15 is always oriented in a direction perpendicular to the screen 4. The carriage 14 has a support 16 that is pivotable about an axis 17 that is perpendicular to the travel direction of the carriage 14. The pivot axis 17 is positioned parallel to the axis 7 of the carriage 5. An arm 18 projects transversely from the support 16 and has at its free end a pivot axis 19 that is perpendicular to the pivot axis 17. A support arm 20 is fixedly connected to this axis and the projecting device 15 is pivotably connected to the free end of this support arm. It can be pivoted about a pivot axis 21 positioned parallel to the axis 19 relative to the support arm 20.

The pivot axes 17, 19, 20 are controlled axes that can be actuated by the control unit (not illustrated). By means of the control unit also the rotation of the car 2 is realized. The movements of projecting device 15, screen 4 and car 2 are matched relative to one another by the control unit in such a way that the passengers seated in the car 2 always have a proper viewing angle relative to the screen 4 so that they can optimally view the action happening on the screen.

The screen 4 is a large format screen so that the action on the screen can be watched easily by the viewers.

The carriage 14 can have at least one further projecting device 15 in particular when the carriage 5 has a matching number of screens 4.

In the illustrated embodiment the image is projected in front projection onto the screen 4. Of course, also rear projection is possible. In this case, the projecting device 15 is arranged on the carriage 5. The travel path 13 is thus not required.

It is advantageous when the spacing of the screen 4 to the car 2 can be changed. This distance change is, for example, possible in that the arm 9 is slidably supported on the support 8. In the same way, the arm 18 can be slidable on the support 16 of the carriage 14.

The control-technological connection between the two carriages 5, 14 can be realized by means of cables. In principle, it is however also possible to make this connection wireless.

FIGS. 1 through 3 show in an exemplary fashion how the different cars and carriages 2, 5, 14 are moved along their travel paths 1, 6, 13 relative to one another. The car 2 with the viewers is moved on the travel path 1 in the direction of the indicated arrow. First (FIG. 1) the car 2 is rotated such that it extends in a direction transverse to the traveling direction of the car 2. The viewers look onto the screen 4 that is positioned, relative to the traveling direction of the carriage 5 on the travel path 6, at an acute angle. The screen 4 is adjusted such that the viewers in the car 2 can view well the action happening on the screen 4. The projecting device 15 is adjusted such that its projection direction extends perpendicularly to the screen 4. As a result of the slanted position of the car 2 the carriage 5 with the screen 4 is positioned in the travel direction slightly behind the car 2 and the carriage 14 of the projecting device 14 in the traveling direction is positioned slightly in front of the car 2.

While the car 2 moves on the travel path 1, the screen 4 is always tracked in such a way that the viewers in the car 2 have visual contact with the screen 4. The car and carriages 2, 5, 14 in the position shown to FIG. 1 can be moved along their travel paths 1, 6, 13. Depending on the lengths of the travel paths 6, 13 a correspondingly long-lasting visual contact of the viewers with the screen 4 is ensured. During traveling it is possible to vary in accordance with the movie shown on the screen the position of the car 2 and thus of the screen 4. For example, movements happening on the screen 4, for example, a vehicle traveling at high speed through a curve, cannot only be visually communicated to the viewers in the car 2 but also physically in that in accordance with traveling through the curve the car 2 carries out a rotation about an axis that is perpendicular to the travel direction. In the same way, the screen 4 and the oppositely positioned projecting device 15 are moved also.

FIG. 3 shows the state where the carriage 5 has reached the end of the travel path 6. In this case, the screen 4 is pivoted about the vertical axis 7 such that it moves out of the movement path of the car 2 on the travel path 1. In the shown embodiment, the screen 4 is rotated in clockwise direction about the axis 7. The projecting device 15 on the opposite side is also pivoted by the same amount about the vertical axis 17 such that the image of the projecting device 15 reaches the screen 4. It is now possible that the carriages 5 and 14 are return into the initial position according to FIG. 1 and accompany the next car that is moving on the travel path 1.

It is however advantageous when the screen 4 upon returning with the next car will cooperate on the travel path 1 in the described way. The screen 4 and the projecting device 15 upon returning are always adjusted to the car 2 on the travel path 1 in such a way that the viewers seated in the car 2 can view the screen 4. This is possible because the screen 4 as well as the projecting device 15 are pivotable about the different axes and optionally also are adjustable in the described way by a translatory movement. The car 2, the screen 4, and the projecting device 15 are adjusted by the control unit in such a way that during travel of the car 2 in the area of the travel paths 6, 13 the viewers in the car 2 always have visual contact with the screen 4.

When comparing FIGS. 1 and 2, the position of the car 2, of the screen 4, and of the projecting device 15 during traveling is always changing. In the illustrated embodiment, the car 2 is rotated on the travel path 1 about the axis that is perpendicular to it in a clockwise direction. In accordance with the rotational movement of the car 2 the screen 4 is rotated. When doing so, the carriage 5 must advance relative to the car 2 in its traveling direction while the carriage 14 with projecting device 15 must stay back in order to align the screen 4 always relative to the viewers in the car 2 in the describe way. In the position according to FIG. 2, the screen 4 projects into the travel path of the car 2. The carriage 5 of the screen 4 is already at the end of the travel path 6 so that the screen 4 can only be pivoted by the amount that the car 2 advances on the travel path 1. The carriage 14 on the travel path 13 moves accordingly wherein the projecting device 15 relative to the carriage 14 is always pivoted such that the image can be projected onto the screen 4.

FIG. 4 shows a larger section of the amusement ride with a car 2 in different positions I to IV. The car 2 is rotatable about the axis that is perpendicular to the travel path 1 in the described way. Along the travel path 1 there are several travel paths 6 on which a carriage 5 with screen 4 can be moved, respectively. The screens 4 are supported in an adjustable way as described above on the carriages 5 and are always aligned relative to the car 2 passing them so that the viewers seated in the car have always an excellent view of the screen 4. As the car 2 passes the screens, advantageously sequential movie scenes are shown on the different screens 4. The car 2 in the embodiment according to FIG. 4 is first oriented such that the viewers in the car 2 view the screen 4 to the right in the travel direction (position I). As the car 2 travels, the screen 4 moves in the way described above in connection with FIGS. 1 to 3 on the travel path 6 wherein the screen 4 is always aligned such that the viewers in the car 2 can view well the action on the screen 4. The carriage 5 with the screen 4 is moved together with the car 2 until the carriage 5 has reached the end of the travel path 6. At the level of this travel path end, the next screen 4 is located on the opposite side of the travel path 1. In order for the viewers in the car 2 to be able to view this screen 4, the car 2 at this transition area is rotated about the axis perpendicular to the travel direction so that the viewers are now looking onto this screen 4 (position II). This rotation of the car 2 can be coupled with appropriate movie sequences on the two screens 4 so that the viewers in the car 2 have the impression that they view a continuous movie sequence on a single screen. For example, at the transition from the first screen to the second screen, a movie sequence on the first screen 4 can end with a bright flash. During this time the car is rotated such that the viewers now look onto the second screen 4. As the car 2 travels, the screen 4 is aligned again in such a way that the viewers in the car 2 have excellent visual contact. In order to achieve this, in the shown embodiment the car 2 during its travel is rotated counterclockwise and the screen 4 is also pivoted counterclockwise. At the same time, the car 5 moves on the travel path 6 opposite to the traveling direction of the car 2.

When the car 2 has reached the position III, it is aligned such that the viewers look onto a stationary screen 22. In this area, the travel path 1 is parallel to the screen 22 and the car 2 is rotated such that the viewers have visual contact with the stationary screen 22.

When it reaches the level of the leading end of the stationary screen 22 in the travel direction, the car 2 is rotated in clockwise direction so that the viewers have visual contact with the screen 4 provided in front of them (position IV).

Depending on the course of the travel path 1 the video devices can be arranged at different positions. The arrangement shown in FIG. 4 is to be viewed only as an example.

Opposite the travel paths 6, as has been disclosed in connection with FIGS. 1 to 3, there can be travel paths 13 with projecting devices 15. In case of rear projection, the projection devices are however also arranged on the carriage 5 so that the travel paths 13 are not required.

Depending on the movies that are shown on the screens 4, the orientation of the car 2 and of the screens 4 and projecting devices 15 can be programmed freely.

The cars 2 can be provided with operating elements in order to provide the viewers on the seats 3 with the possibility of actively engaging in the action shown on the screens 4. For example, the viewers must shoot with laser guns or the like at targets on the screens 4 that are attacking. Such games are known and therefore require no further explanation. The car 2 or the seats 3 for this purpose are provided with corresponding game interfaces.

It is also possible that viewers seated in the car 2 are in competition with viewers waiting in front of the amusement ride. A prerequisite for this is that on the screens 4 a corresponding game is shown. The game is shown on a screen to the persons waiting in front of the amusement ride. With corresponding game interfaces, the viewers in the car 2 can play against those waiting in front of the amusement ride.

Furthermore, there is the possibility that the viewers in the car 2 play against a gaming computer whose games are transmitted to the screens 4. Such video games are known. There is the possibility that the video game has different levels that must be reached by the viewers in the car 2. Once a gaming level has been reached, this can be rewarded in that the car 2 is moved onto the next section of the amusement ride where the viewers in the car 2 have access to the next level of the game. When this level has been reached, it is possible, for example, to move the car 2 onto the next travel path section. In this way, depending on the number of gaming levels, the car 2 can be advanced onto different travel path sections. Of course, other rewards are also possible when the gaming level has been reached.

In the shown embodiment, the cars 2 and the screens 4 as well as the projecting devices 15 are rotated. It is also possible to rotate the travel paths 6, 13 about an axis that is perpendicular to the travel direction of the carriages 5, 14.

The specification incorporates by reference the entire disclosure of German priority document 10 2007 048 012.3 having a filing date of Sep. 27, 2007.

While specific embodiments of the invention have been shown and described in detail to illustrate the inventive principles, it will be understood that the invention may be embodied otherwise without departing from such principles.

What is claimed is:

1. An amusement ride comprising:

at least one travel path;

cars provided with at least one seat and traveling on the at least one travel path;

at least one screen displaying movies, the at least one screen arranged adjacent to the at least one travel path, wherein the at least one screen follows a car at least over a section of a travel distance of the car;

a transport element, wherein the at least one screen is arranged on the transport element;

an auxiliary travel path, wherein the transport element is movable along the auxiliary travel path together with the at least one screen;

wherein the at least one screen is programmed so as to freely move about three axes.

2. The amusement ride according to claim 1, wherein one of the three axes is perpendicular to a travel direction of the transport element.

3. The amusement ride according to claim 1, wherein on the transport element at least two of the at least one screen are arranged.

4. The amusement ride according to claim 1, wherein the at least one screen is adjustable by translation and rotation.

5. The amusement ride according to claim 1, wherein a distance of the car relative to the at least one screen is controllable.

6. An amusement ride comprising:

at least one travel path;

cars provided with at least one seat and traveling on the at least one travel path;

at least one screen arranged adjacent to the at least one travel path, wherein the at least one screen follows a car at least over a section of a travel distance of the car;

a transport element, wherein the at least one screen is arranged on the transport element;

an auxiliary travel path, wherein the transport element is movable along the auxiliary travel path;

at least one projecting device correlated with the at least one screen.

7. The amusement ride according to claim 6, further comprising a transport element, wherein the at least one screen is arranged on the transport element and the at least one projecting device is arranged on the transport element.

8. The amusement ride according to claim 7, further comprising an auxiliary travel path, wherein the transport element is movable along the auxiliary travel path.

9. The amusement ride according to claim 6, further comprising a separate travel path and a transport element for the at least one projecting device, wherein the transport element travels on the separate travel path, wherein the at least one projecting device is connected to the transport element.

10. The amusement ride according to claim 9, wherein the projecting device is arranged on the transport element so as to be pivotable about at least one axis.

11. The amusement ride according to claim 9, wherein the at least one projecting device is pivotable about an axis that is perpendicular to a travel direction of the transport element.

12. The amusement ride according to claim 9, wherein the car is pivotable about an axis that is perpendicular to a travel direction of the car.

13. An amusement ride comprising:

at least one travel path;

cars provided with at least one seat and traveling on the at least one travel path;

at least one screen displaying movies, the at least one screen arranged adjacent to the at least one travel path, wherein the at least one screen follows a car at least over a section of a travel distance of the car;

wherein the orientation between the car and the at least one screen is freely programmable and the at least one screen is always tracked relative to the car that viewers in the car have visual contact with the at least one screen.

14. The amusement ride according to claim 13, further comprising a transport element, wherein the at least one screen is arranged on the transport element and wherein the at least one screen is adjustable about three axes.

15. The amusement ride according to claim 14, further comprising an auxiliary travel path, wherein the transport element is movable along the auxiliary travel path.

16. The amusement ride according to claim 13, wherein a distance of the car relative to the at least one screen is controllable.

17. An amusement ride comprising:

at least one travel path;

cars provided with at least one seat and traveling on the at least one travel path;

at least one screen arranged adjacent to the at least one travel path, wherein the at least one screen follows a car at least over a section of a travel distance of the car;

a transport element, wherein the at least one screen is arranged on the transport element;

an auxiliary travel path, wherein the transport element is movable along the auxiliary travel path;

wherein the car is provided with at least one gaming console for an active participation of passengers in the car in a game shown on the at least one screen.

18. The amusement ride according to claim 17, wherein each of the at least one seat is provided with one of the at least one gaming console.

19. The amusement ride according to claim 17, wherein passengers in the car play a game that is running on the at least one screen against persons outside of the car.

* * * * *